United States Patent [19]

Lane

[11] 4,034,494

[45] July 12, 1977

[54] HOLIDAY LIGHT

[76] Inventor: Chet M. Lane, 411 E. Passaic St., Apt. No. E, Hackensack, N.J. 07601

[21] Appl. No.: 618,774

[22] Filed: Oct. 2, 1975

[51] Int. Cl.[2] ..... B44F 1/00

[52] U.S. Cl. ..... 40/106.52; 40/132 F; 240/10.1; 356/216

[58] Field of Search ..... 40/133 A, 132 E, 132 G, 40/132 F, 106.52–106.54, 34, 40; 240/2 AT, 2 R, 2 AD, 10.1; 356/216; 340/227

[56] References Cited

U.S. PATENT DOCUMENTS

| | | | |
|---|---|---|---|
| 1,437,194 | 11/1922 | Raff | 40/106.54 |
| 2,371,172 | 3/1945 | Hotchner | 40/132 F |
| 2,846,799 | 8/1958 | Viszlocky et al. | 40/106.53 |
| 3,080,474 | 3/1963 | Allen | 40/34 X |
| 3,160,975 | 12/1964 | Malina | 40/132 G |
| 3,736,698 | 6/1973 | Nesbitt | 356/216 X |

*Primary Examiner*—John F. Pitrelli
*Attorney, Agent, or Firm*—Eugene V. Mandel

[57] ABSTRACT

A picture display unit comprising an internal light source, a mirror, a rotatable disc, a diffuser, and intermediate sheets.

7 Claims, 2 Drawing Figures

HOLIDAY LIGHT

BACKGROUND OF THE INVENTION

This invention relates to picture display units, and, in particular, to units which modify the appearance of the picture to the viewer. It relates more particularly to displays for back lighted pictures. It pertains more particularly to units containing internal mirrors. It relates also to displays which constantly change.

Picture displays have long been known. Some back lighted displays have been known. Attention getting displays have many desirable applications.

The essence of this invention is a picture display unit, back lighted, with options of changing color and providing motion simulation. The motion simulator is a non motor driven energy absorbing rotator.

The entire unit is compact and can be operated from alternate, natural sources of energy. The unit is capable of random installation outdoors as well as indoors. The unit can be made in almost any size.

Still another object is to provide a unit capable of operating from natural energy sources without any connection to electrical lines. Yet a further purpose is to permit installation outdoors, as well as indoors.

The object of this invention is to provide a picture display unit embodying improved principles of design and construction. An important object of the invention is to provide a unit which can be economically manufactured and assembled. An additional object is to provide a back lit display unit with the option of changing basic atmosphere. A further object is to provide the option of continuously changing light transmission. Another object is to provide a moving device without a motor.

DESCRIPTION OF DRAWINGS

Further objects and advantages of this invention will appear more clearly from the following description of a non-limiting illustrative embodiment and the accompanying drawings in which like numerals designate like parts thruout the several views.

DESCRIPTION OF TYPICAL EMBODIMENT

Figure 1:
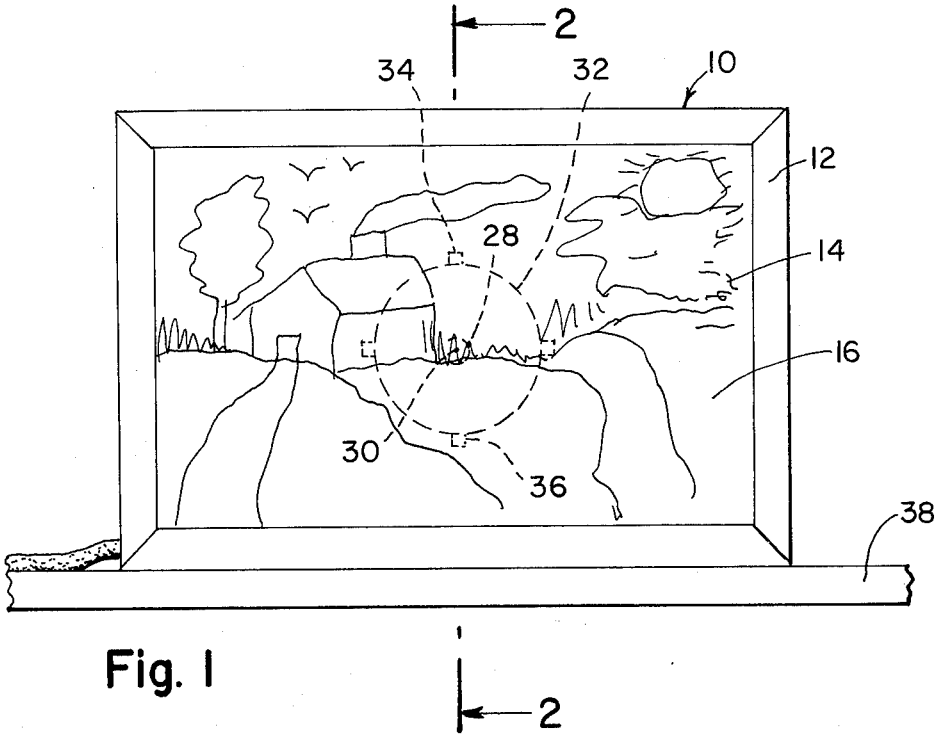
FIG. 1 is a front view of a picture display unit incorporating the principles of this invention.
Figure 2:
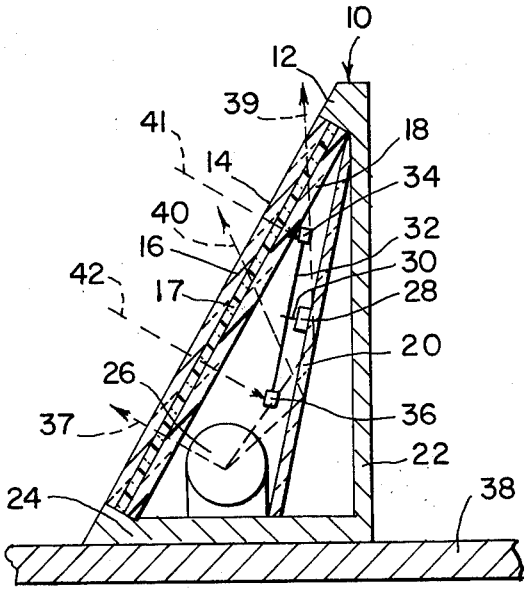
FIG. 2 is a sectional view taken on line 2—2.

In the drawings a picture display unit 10 embodying features of the invention is illustrated wherein a picture 14 or other message is laid upon a sheet of glass 16 which may be backed by a colored overlay sheet 17 which may be made of plastic and is generally commercially available and is here used to modify the general appearance or atmosphere by providing a predominant color. Another optional backing is a diffuser 18 made of such well known material as Factrolite or the like to improve the uniformity of distribution of light. This is all mounted on the front of frame 12 suitably supported by frame cutouts and/or fasteners.

Mirror 20 in the rear of the unit reflects light towards and thru picture 14 to provide known back lighting effects.

Light source 26 may be provided to emit light rays 39, 40 which may strike the mirror and be reflected or may pass directly 37 to the picture 14.

A rotating member 32 which may be in disc form and could be mounted upon a center 30 such as a shaft in a housing 28 - carries several "flags" 34, 36 having one face of the flag coated with energy absorbing material such as lamp black and the other face coated with an energy reflecting material such as aluminum paint. All the similarly coated faces are to be mounted oriented in a similar direction. This construction is well known and is generally referred to as a "RADIOMETER" and is so described in several physics textbooks.

The sum of the accepted energy input on the one set of faces as compared to the energy rejected by the opposite side faces provides a net force which, at the mean radius of the flags, causes the disc 32 to rotate about center 30. Natural light rays 41, 42 entering thru the picture and striking flags 34, 36 similarly cause rotation. Disc 32 may be solid or have openings such as holes or slots at random or in organized patterns, which disrupt the light flow and create various optical illusions such as motion in the picture 14. Disc 32 may also be transluscent and colored or made of several colored materials to create colored optical effects which have been popularly referred to as "psychedelic," "dancing shadows" and the like.

The light source 26 may be any known type including electrically operated incandescent or fluorescent lights.

The frame and supports are as required to structurally complete the unit including back wall 22 and bottom 24 which may rest upon any external member such as a table 38.

The unit may be used with an electric lamp requiring standard electrical wiring or it may be used with other light sources including natural light, requiring no complexities of installation, and permitting ready use anywhere.

The invention includes all novelty residing in the description and drawings. It is obvious to those skilled in the art that various minor changes can be made without departing from the concept of this invention and all such as fall within the reasonable scope of the appended claims are claimed.

What is claimed is:

1. A picture display unit comprising: a frame an outer sheet of glass having indicia thereon, a colored overlay sheet positioned behind said outer sheet, a diffuser sheet positioned behind said overlay sheet, and a frame for supporting said sheets in juxtaposed relation, said frame further including therewithin a mirror facing towards the diffuser sheet, at least one disc rotatable about its center and serving as a light modifying means, a plurality of flags attached to the disc, one face of each flag having a light reflective coating, and the other face having a light absorbing coating, all similarly coated faces oriented in a similar direction, and a light source from which emanate rays of light which impinge upon the flags causing the disc to rotate due to impingement of light thereon, the rays of light passing directly or by reflection from the mirror to the diffuser sheet and through the outer sheet.

2. A picture unit as in claim 1 in which the diffuser may be made of Factrolite.

3. A picture unit as in claim 1 in which the overlay sheet comprises plastic.

4. A picture unit as in claim 1 in which the light source is incandescent.

5. A picture unit as in claim 1 in which the light source is fluorescent.

6. A picture unit as in claim 1 in which the rotatable disc is colored.

7. A picture unit as in claim 1 in which the disc has openings to pass light therethrough.

* * * * *